United States Patent [19]

Aula et al.

[11] Patent Number: 4,693,784

[45] Date of Patent: Sep. 15, 1987

[54] SUCTION ROLL AND METHOD FOR APPLYING A NEGATIVE PRESSURE OVER A SECTOR OF A ROLL

[75] Inventors: Jouko Aula; Reima Kerttula, both of Jyväskylä , Finland

[73] Assignee: Valmet Oy, Finland

[21] Appl. No.: 851,480

[22] Filed: Apr. 14, 1986

[30] Foreign Application Priority Data

Apr. 17, 1985 [FI] Finland ..... 851533

[51] Int. Cl.[4] ..... D21F 3/10; D21F 5/04

[52] U.S. Cl. ..... 162/202; 29/121.1; 34/115; 34/116; 83/100; 162/368; 162/369; 162/371

[58] Field of Search ..... 162/368–372; 34/115, 116, 117, 123; 83/100; 29/116 R, 121.1

[56] References Cited

U.S. PATENT DOCUMENTS

| | | | |
|---|---|---|---|
| 3,902,960 | 9/1975 | Zentner et al. | 162/369 |
| 4,016,032 | 4/1977 | Kankaanpaa | 162/368 |
| 4,485,567 | 12/1984 | Ely | 34/115 |
| 4,492,044 | 1/1985 | Knutsen | 34/116 |

FOREIGN PATENT DOCUMENTS

| | | | |
|---|---|---|---|
| 595854 | 4/1960 | Canada | 162/369 |

*Primary Examiner*—S. Leon Bashore
*Assistant Examiner*—K. M. Hastings
*Attorney, Agent, or Firm*—Steinberg & Raskin

[57] ABSTRACT

A method for applying a negative pressure over a sector of an air-pervious mantle of a roll includes providing a suction chamber within the pervious roll mantle which extends over a suction sector of the roll, directing air jets away from the suction chamber at the outermost edge portions of the suction chamber, the air jets causing air currents to be ejected from the suction chamber at the outermost edge zones thereof, the air currents thereby producing air seals at the outermost edge zones of the suction chamber without the use of contact-type sealing elements and at the same time, at least partly, providing a negative pressure in the suction chamber. A suction roll includes blow nozzles for directing air jets away from the suction chamber substantially parallel to the tangent of the roll mantle proximate to the blow nozzles. The inlet sides of the blow nozzles are connected to a pressure chamber situated within the roll mantle, the pressure chamber adapted to be connected to a pressure source.

25 Claims, 11 Drawing Figures

SUCTION ROLL AND METHOD FOR APPLYING A NEGATIVE PRESSURE OVER A SECTOR OF A ROLL

BACKGROUND OF THE INVENTION

The present invention relates to methods for applying a negative pressure over a suction sector of an air-pervious mantle of a rotating roll within which a suction chamber is situated which extends over the suction sector of the roll.

The invention also relates to a suction roll comprising a cylindrical air-pervious mantle and which is rotatably mounted at its ends and within the interior of which a suction chamber is situated.

Suction rolls comprising air-pervious mantles having zones subjected to negative pressure are known. Such rolls are used in apparatus for manufacturing and processing various web-like materials, such as paper, textile or plastic webs, as well as in apparatus that process sheet materials, such as printing machines or sheet cutters. Generally, such rolls are provided with perforated and/or grooved mantles through which negative pressure is applied to the web or sheet that is in contact with the suction zone of the roll.

A commonly used conventional suction roll of the type used in paper machines comprises an air-pervious mantle within which a suction box defining the suction zone is situated. The interior of the suction box is connected to suction source through the end or ends of the roll.

Such conventional suction rolls require the use of axial seals and end seals for the suction box which rub against the inner surface of the roll mantle. Consequently, these seals tend to wear during use and eventually must be replaced which is considered to be a drawback of this conventional construction. Another drawback is that the inner surface of the suction roll must be machined and ground with a high degree of precision to obtain a good sealing surface for the suction box. This increases the manufacturing costs of the roll. A suction roll provided with contact-type sealing elements also requires relatively frequent servicing which of course results in down time in the production process. The sealing water which is occasionally used in connection with suction rolls in paper machines also causes problems.

SUMMARY OF THE INVENTION

It is an object of the present invention to provide a new and improved method and suction roll by means of which drawbacks of conventional suction rolls can be avoided.

Another object of the present invention is to provide a new and improved suction roll which does not require contacttype sealing elements.

Still another object of the present invention is to provide a new and improved suction roll having an airpervious mantle, the inner surface of which does not necessarily have to be machined with the same precision as conventional suction rolls.

A further object of the present invention is to provide a new and improved method and suction roll for applications in which the level of negative pressure required is relatively low.

In accordance with the present invention, these and other objects are attained by providing a method wherein air jets are directed away from the suction chamber of the roll in the region of outer edge zones of the suction chamber which cause air currents to be ejected from the suction chamber at the outermost edge zones thereof. The air currents produce air sealing at the outermost edge zones of the suction chamber without the use of contact-type sealing elements and, at least partly, produce a negative pressure in the suction chamber.

In accordance with the invention, a suction roll is provided wherein a suction chamber is provided within the interior of the roll mantle and wherein contact-free air seals are provided between the suction chamber and the inner surface of the roll mantle by means of blow nozzles which direct air jets away from the suction chamber substantially parallel to the tangent of the adjoining roll mantle. The inlet side of each blow nozzle is in communication with a pressure chamber situated within the interior of the roll mantle, the pressure chamber adapted to be connected to a pressure source.

The method and apparatus of the invention can be used in any apparatus for the production and/or handling of web material. For example, the suction roll can be used in a paper machine and, in particular, in the drying section of a paper machine, in printing machines or sheet cutters as well as in other apparatus that process web or sheet material. Generally, the method and apparatus are useful in applications where the required level of negative pressure is relatively low.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
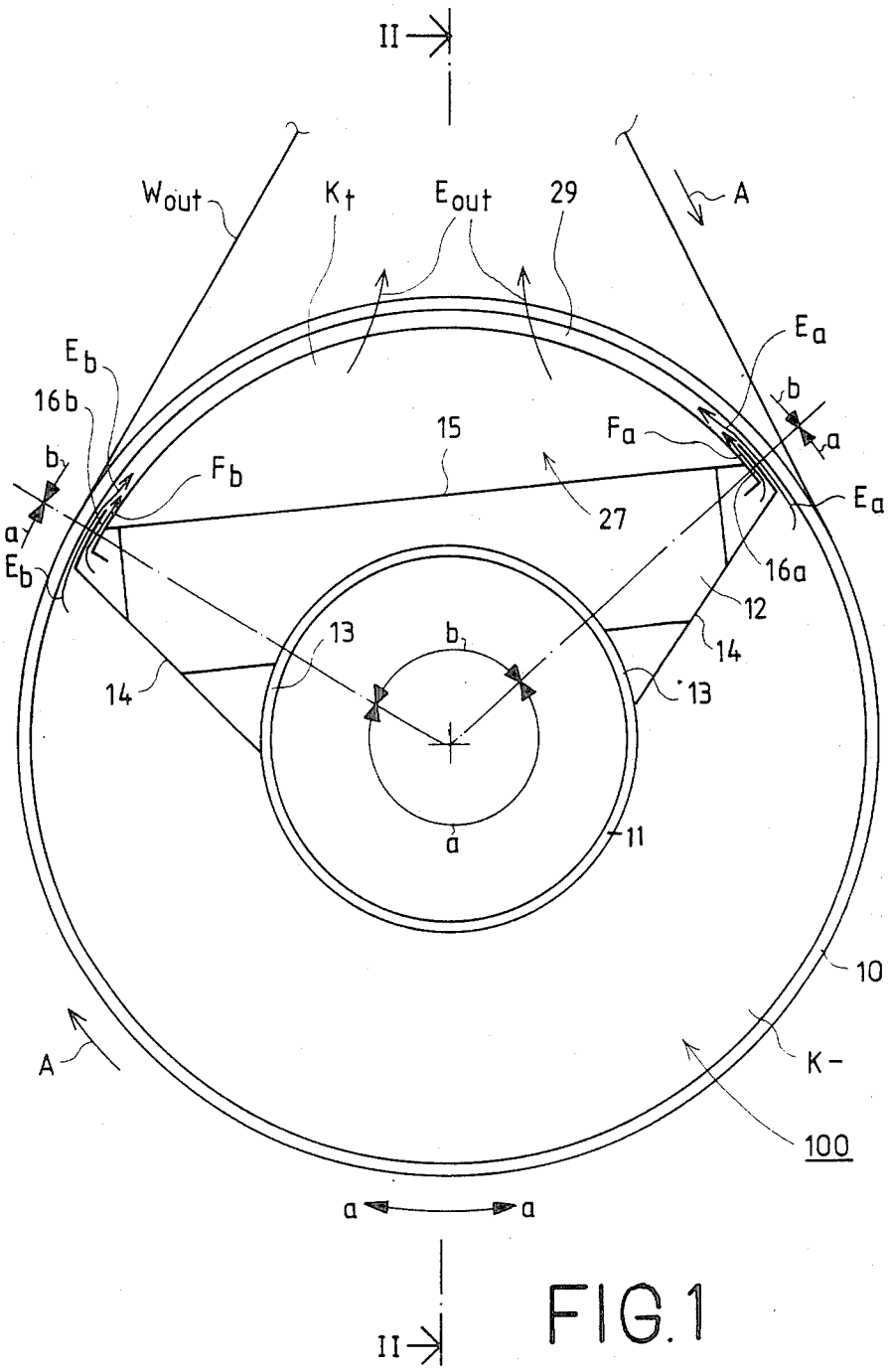
FIG. 1 is a transverse section view of a suction roll in accordance with the invention taken along line I—I of FIG. 2.
Figure 2:
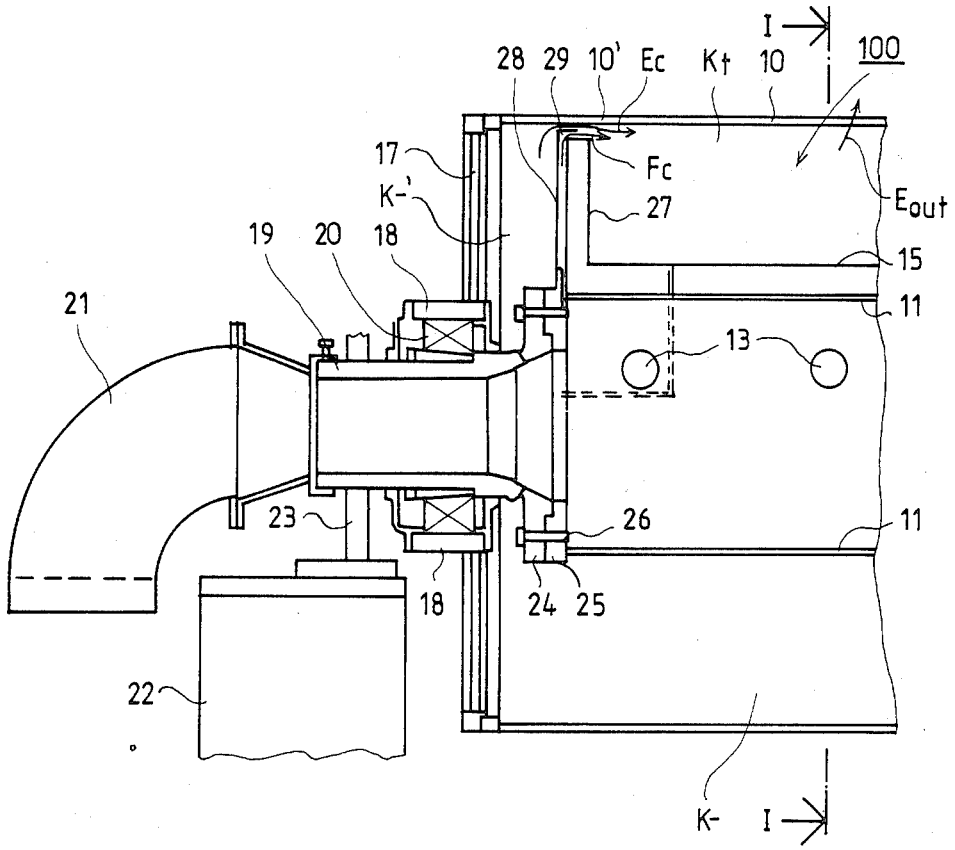
FIG. 2 is a section view taken along line II—II of FIG. 1 and showing an axial end region of a suction roll in accordance with the invention.

Referring now to the drawings wherein like reference characters designate identical or corresponding parts throughout the several views, and more particularly to FIGS. 1 and 2, a suction roll 100 in accordance with the invention has a suction sector a which is greater than 180° and a pressure sector b whose magnitude is substantially 360° - a. The roll 100 comprises a cylindrical mantle 10 having perforations 10' (FIGS. 3 and 4) which is rotatably mounted on bearings 20 fitted on the ends 17 of the roll. The mantle 10 is substantially open with the ratio of the area of perforations 10' to the entire area of the mantle 10 being between 5 to 80% and preferably about 20%. The particular ratio depends upon the particular application for the roll and on the quantities of pressurized air to be used so that no substantial pressure differential exists in the perforations 10' of roll 100 at the positive pressure side.

Figure 10:
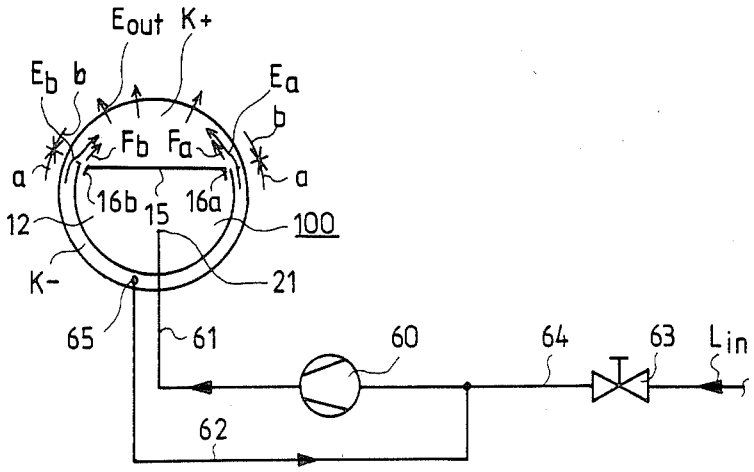
FIG. 10 is a schematic view illustrating a suction roll in accordance with the invention communicating with a blower which provides intensified suction or negative pressure.

A stationary blow tube 11 is situated within the mantle 10 of roll 100, preferably extending substantially coaxially with the mantle 10. Blow tube 11 is attached to a tubular shaft 19 by means of flanges 24 and 25 and a threaded fastener 26. The tubular shaft 19 is itself mounted on supports 23 on the base 22 of roll 100. The bearing 20 of roll 100 is mounted on the tubular shaft 19 while the bearing bushing 18 is attached to the end 17 of mantle 10 of roll 100. The tubular shaft 19 is connected to a blow pipe 21 which communicates with a pressure source, such as a blower 60 (FIG. 10).

Figure 6:
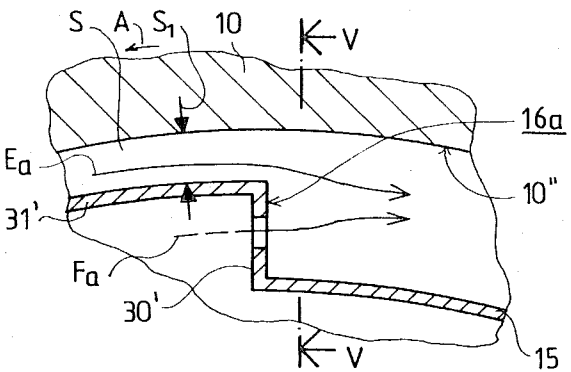
FIG. 6 is a section view taken along line VI—VI of FIG. 5.

Still referring to FIGS. 1 and 2, the blow tube 11 situated within the mantle 10 of roll 100 is provided with openings 13 through which pressurized air is admitted into a blow box 12 defined by axially extending walls 14 and 15 and end walls 27 (only one shown). The walls 14 are connected to the blow tube 11 and are provided with extensions in the form of walls 31;31' (FIGS. 3–6). Correspondingly, the wall 15 is provided with extensions in the form of walls 30; 30'. The walls 30, 31; 30', 31', define blow nozzles **16*a* and 16*b* at locations proximate to the inner surface of the roll mantle 10 and which extend in the axial direction of roll 100 substantially over the entire length of the roll mantle 10 within the area between the end walls 27. The blow nozzles 16*a* and 16*b* have inlet ends communicating with the pressurized air in blow box 12 and direct air jets $F_a$ and $F_b$ substantially in a direction parallel to the tangent of the mantle at the region of the blow nozzles. As seen in FIG. 1, the air jets $F_a$ and $F_b$ are directed away from the suction chamber, designated K−, at circumferentially spaced, axially extending outermost edge zones of the suction chamber situated proximate to the inner surface 10' of the roll mantle. In the embodiment shown in FIGS. 1, 3 and 4, the blow nozzles 16*a* and 16*b* comprise nozzle slots 32 which operate by the Coanda principle. In the embodiment of FIGS. 5 and 6, the blow nozzles each comprise a set of openings 32' provided in a wall 30' connecting the walls 15 and 31 of the blow box 12**.

The blow nozzles **16*a*, 16*b* function to create non-contacting air seals for the suction chamber K− and it is an essential feature of their construction and operation that the air jets directed through them cause a negative pressure to be created in the suction chamber K− over the suction sector a of the roll mantle 10. Thus, it is seen in the figures that the blow nozzles 16*a*, 16*b* do not contact the inner surface 10'' of the mantle 10 of roll 100. Rather, a gap S (FIG.3) of an appropriate magnitude exists between the inner surface 10'' of mantle 10 and the blow nozzles. The air jets $F_a$ and $F_b$ directed through the blow nozzles 16*a* and 16*b*** cause air currents $E_a$ and $E_b$ to be ejected from the suction chamber K− through the gaps S which generate a negative pressure in the chamber K−. It is seen from the foregoing that seals are created at the boundary of the suction sector a without the need for contact-type axial seals.

A pressure chamber K+ is formed within the mantle 10 of roll 100 into which the air jets $F_a$ and $F_b$ and the air currents $E_a$ and $E_b$ are directed. The pressure chamber K+ extends over a pressure sector b of the roll mantle 10 and pressurized air is discharged from the pressure chamber K+ through the perforations 10' in the mantle 10 as indicated by the arrows designated $E_{out}$.

Referring to FIG. 2, the axial ends of the suction chamber K−, designated K−', are also provided with ejection nozzles 29 formed between the end walls 27 and stationary walls 28 (only one shown) through which air jets $F_c$ are directed. The air jets $F_c$ cause air currents $E_c$ to be ejected from the ends K−' of suction chamber K−. In certain applications, it is also possible to use contact-type end seals instead of the end air seals, the contact seals having a slight contact or forming a small gap (0 to 2 mm) with the roll mantle in which case a small leakage flow into the suction chamber K− is permitted.

Various applications of a suction roll in accordance with the invention are illustrated in FIGS. 7–10.

Figure 7:
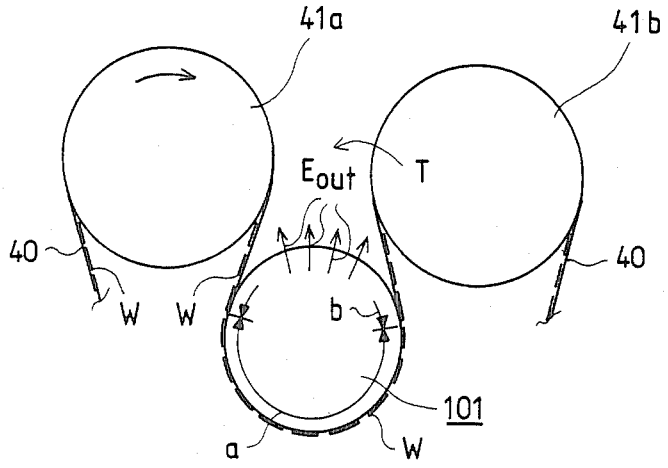
FIG. 7 is a schematic illustration of a closed, single-wire draw drying section of a paper machine utilizing a suction roll in accordance with the invention.

Referring to FIG. 7, a suction roll 101 in accordance with the invention is provided with a suction sector a. The suction roll 101 is arranged to operate in a single-wire draw drying section of a paper machine. Steam-heated drying cylinders **41*a* and 41*b* are provided against which the web W to be dried is pressed by a drying wire 40. In the apparatus shown in FIG. 7, the lower cylinders of the conventional drying section are replaced by suction rolls 101 in accordance with the invention whose suction sectors a maintain the web W on the surface of the drying wire 40 during the run of the web W where the web is situated on the outer surface of the wire 40. The cylinders 101** may be cooled in accordance with the principles set forth in Finnish Patent application No. 842285 of applicant's assignee corresponding to U.S. application Ser. No. 741,227, now U.S. Pat. No. 4,625,430.

The use of such rolls 101 in accordance with the invention in the manner illustrated in FIG. 7 is also advantageous in that the air flow directed through the mantle 10 over the pressure sector b ventilates the pockets T between the drying cylinders **41*a*, 41*b*** to thereby promote the drying of the web W.

Figure 8:
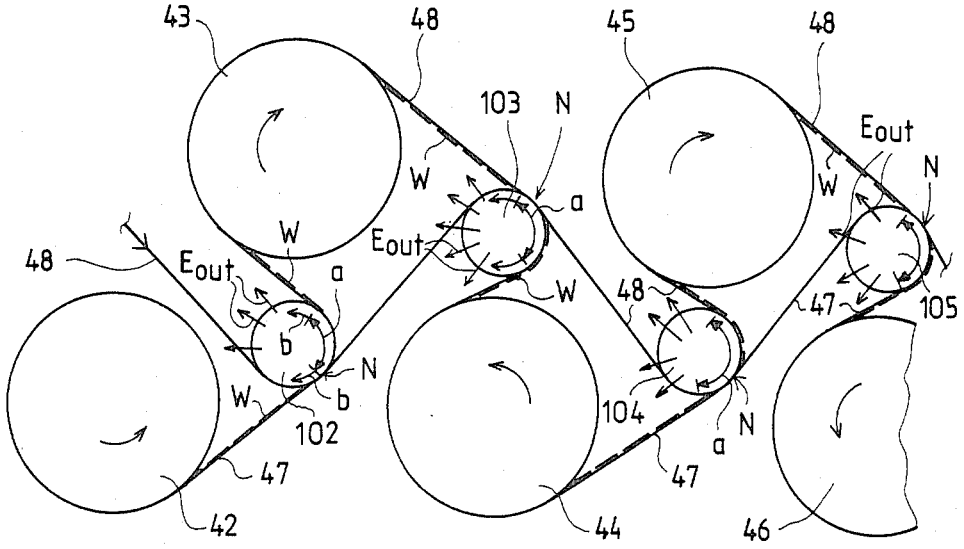
FIG. 8 is a schematic view of a twin-wire draw drying section of a paper machine utilizing a suction roll in accordance with the invention.

Referring to FIG. 8, a second application of the invention is illustrated, also in connection with the drying section of a paper machine. The drying section comprises a twin-wire draw drying section including upper drying cylinders 43, 45 and an upper drying wire 48, and lower drying cylinders 42, 44 and 46 and a lower drying wire 47. Guide rolls for drying wires 47 and 48 are situated as shown in FIG. 8 between the drying cylinders and comprise suction rolls 102, 103, 104, 105 in accordance with the invention provided with suction sectors a and pressure sectors b. The drying wires 47 and 48 form transfer nips N in connection with the suction rolls 102–105 at which the web W to be dried is transferred from one wire onto the other wire. The drying wires 47 and 48 may be relatively pervious so that the pressurized air $E_{out}$ discharged from the pressure sectors b of the suction rolls 102–105 promotes the ventilation of the substantially closed pockets formed between the cylinders and the drying wires. The suction rolls in accordance with the invention provide a dual advantage when used in drying sections of the types shown in FIGS. 7 and 8, i.e., in addition to maintaining contact between the web and the drying wire, the suction rolls provide ventilation for the pockets in the drying section.

Figure 9:
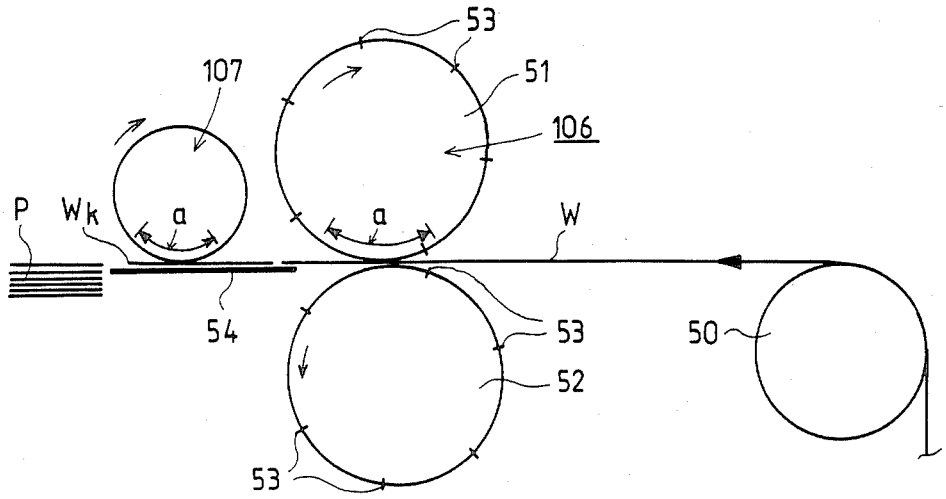
FIG. 9 is a schematic view illustrating a paper sheet cutter utilizing a suction roll in accordance with the invention.

Referring now to FIG. 9, suction rolls 106 and 107 in accordance with the invention are used in apparatus for cutting paper sheets $W_k$ from a web W. The sheet cutter is formed between rolls 51 and 52 which are provided with blades 53. The continuous web W is passed between rolls 51 and 52, guided by guide roll 50, whereupon the sheets $W_k$ are cut out from the web by means of the blades 53. The upper cutter roll 51 comprises a suction roll 106 in accordance with the invention provided with a suction sector a by means of which the cutoff sheet $W_k$ remains in contact with the surface of the upper roll 51 and passes via the top of the guide plate 54 to be carried by a suction roll 107 provided with a suction sector a in accordance with the invention. The sheet $W_k$ is shifted by means of a suction roll 107 onto the stack P.

Referring to FIG. 10, one example of the connection of a suction roll 100 in accordance with the invention to a blower 60 is illustrated. The pressure side of the blower 60 is connected by a duct 21 with the blow box 12 from which air jets $F_a$ and $F_b$ are directed through blow nozzles 16*a* and 16*b* into the pressure chamber K+. The suction chamber K− extends over the suction sector a of suction roll 100. The air jets $F_a$ and $F_b$ cause air currents $E_a$ and $E_b$ to be ejected from the suction chamber K− to produce a negative pressure in the suction chamber K−. The chamber K− is connected to the duct 64 at the suction side of blower 60 by means of a connection 65 and a suction duct 62. Ambient air may also be taken into the suction duct 64 (arrow $L_{in}$) through a regulating valve 63. By means of the regulating valve 63, it is possible to adjust the pressure level in the system. By means of the additional suction provided to the chamber K− in accordance with the embodiment of FIG. 10, it is possible to intensify the negative pressure which exists within the suction chamber K− and which prevails over the suction sector a.

Figure 11:
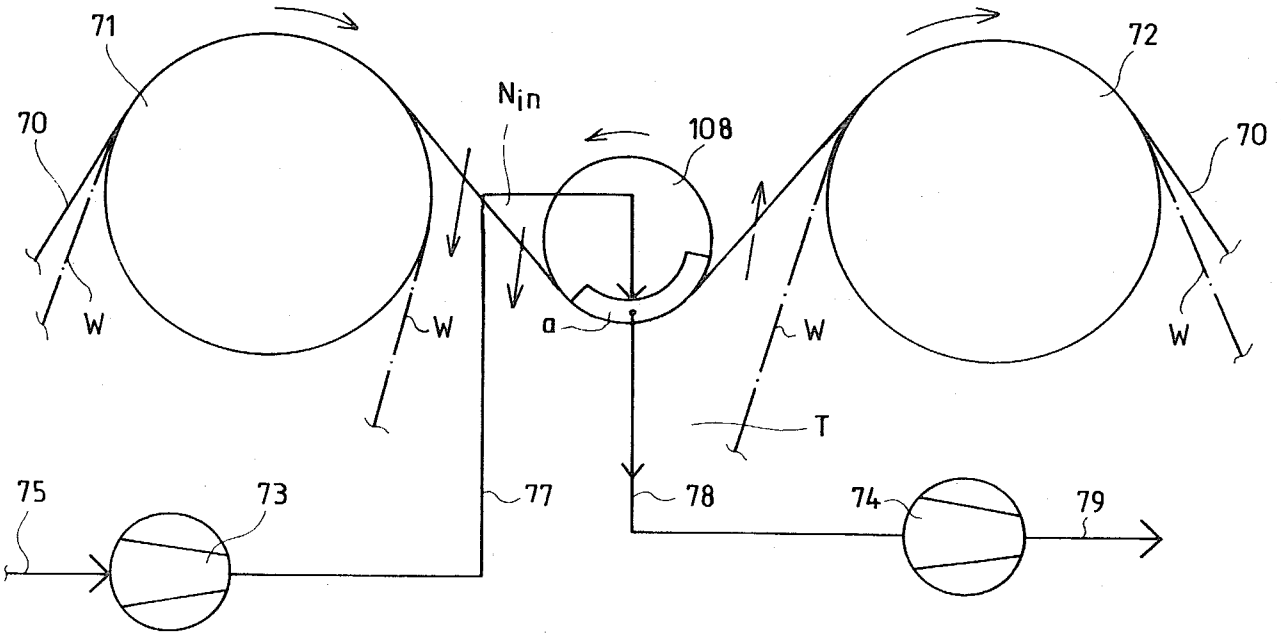
FIG. 11 is a schematic view illustrating the application of a suction roll in accordance with the invention in the drying section of a paper machine as a combined wire guide roll and pocket ventilation roll.

Referring to FIG. 11, a preferred embodiment of a twin-wire draw drying section of a paper machine using a suction roll in accordance with the invention is illustrated. Two drying cylinders 71 and 72 of an upper line of drying cylinders are illustrated along with relatively open drying wire 70 which runs over the drying cylinders guided by combined guide rolls and pocket ventilation rolls 108 in accordance with the invention situated between the cylinders 71 and 72. Corresponding combined guide rolls and pocket ventilation rolls 108 are provided between lower drying cylinders (not shown) to guide the lower wire (also not shown). The web W to be dried which runs in the drying section has free and supported runs when running from cylinders of the upper line to cylinders of the lower line and vice-versa. The drying wires press the web W against the surfaces of the drying cylinders as is known. The pockets T defined by the drying wires and free runs of the web W require ventilation. As shown in FIG. 11, dry blowing air is used for sealing the boundaries of the suction sector a. A negative pressure is provided in the suction chamber of roll 108 by means of a duct 75 which is connected to a blower 73 which directs pressurized air through a duct 77 into the blow box 12 situated within the roll 108. In this manner, air jets are directed away from the suction chamber to cause air flows to be ejected therefrom to create the negative pressure along the suction sector a. The chamber K− of roll 108 is connected by means of a duct 78 to the suction side of a blower 74 and the pressure side of the blower 74 is connected through a duct 79 to heat recovery equipment.

In accordance with the embodiment of FIG. 11, in a twin-wire draw drying section, warm air (T=105° C., h=50 $gH_2O$/kg of dry air) is introduced for sealing the suction sector a by means of negative pressure as described above. The dry air and warm ventilation air is pumped by a wire 70 in roll 108 to move into the pocket T through the wire 70 from the inlet nip $N_{in}$. By means of the negative pressure in the duct 78, moist air (T=90° C., h=300 $gH_2O$/kg of dry air) is suctioned from the pocket T and then preferably directed to a heat recovery device. An advantage of the illustrated system is that it obtains improved efficiency in heat recovery since moist recovery of heat is more efficient than dry recovery of heat. Normally, heat recovery operates at a moisture of 120 to 180 $gH_2O$/kg dry air.

The negative pressure prevailing over the suction sector a of suction roll 100–107 in accordance with the invention is generally within the range of between about 50 to 300 Pa. If required, this pressure level can be made adjustable such, for example, as by regulating the intensity of the air jets $F_a$ and $F_b$ and/or by means of a regulating valve 63 (FIG. 10) or by means of other corresponding control apparatus.

It is understood that the invention also includes embodiments in which the suction chamber K− is connected to a completely separate source of negative pressure so that the negative pressure produced over the suction sector a or within a corresponding suction sector is generated mainly by means of the separate suction source. In such a case, the non-contacting blow nozzles in accordance with the invention operate primarily as sealing means, contributing to the generation of negative pressure in the suction chamber K− or functioning mainly to prevent access of air into the suction chamber K− through the gaps S.

Figure 4:
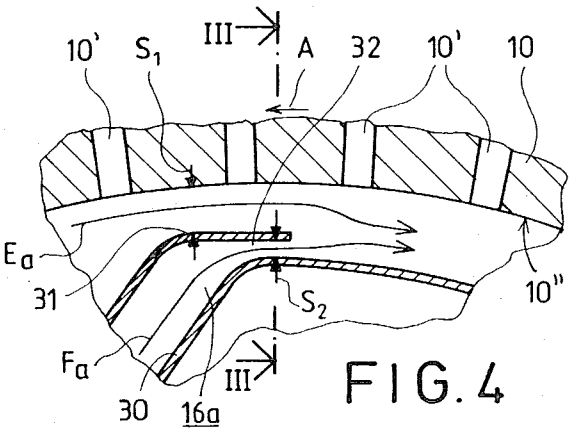
FIG. 4 is a section view taken along line IV—IV of FIG. 3.
Figure 5:
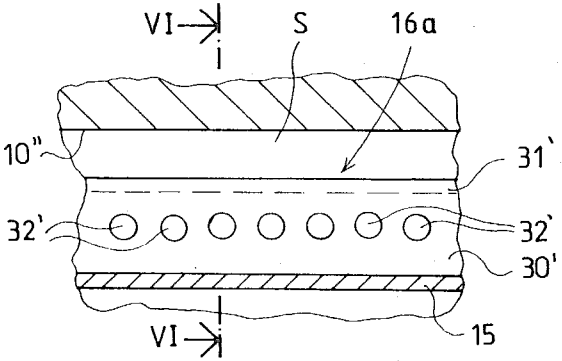
FIG. 5 is a detailed axial section view showing an alternate embodiment of a blow nozzle forming part of the invention, taken along line V—V of FIG. 6.

The nozzles 16*a* and 16*b* situated at opposite outermost edges of the suction sector a of roll 100–107 may differ from each other, such as in the case where rotation of the roll mantle 10 induces air flow out of the suction chamber (FIGS. 4 and 6, arrow A). Thus, rotation of the roll mantle 10 will produce an air flow in the direction of one of the air currents $E_a$ and $E_b$ and in an opposite direction at the other side.

Figure 3:
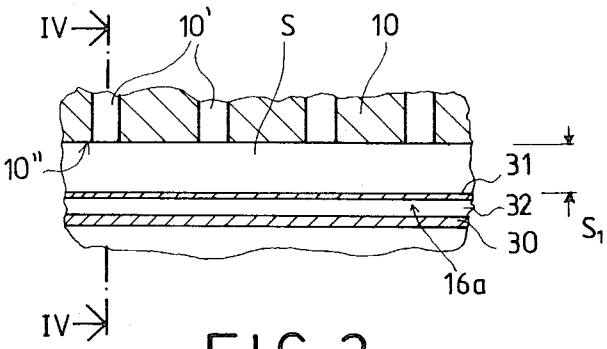
FIG. 3 is a detailed axial section view of a suction roll in accordance with the invention taken along line III—III of FIG. 4 and illustrating a blow nozzle forming part of the invention.

The gap $S_1$ between the top wall 31;31' of the blow nozzle and the inner surface 10'' of the roll mantle 10 opposing nozzle 16*a*;16*b*, must be sufficiently large so that no contact between these components exists. On the other hand, the gap $S_1$ must be small enough so that a sufficiently efficient ejection effect can be obtained by means of the air jets $F_a$ and $F_b$. The magnitude of gap $S_1$ is generally within the range of 3 to 30 mm., and preferably within the range of between about 8 to 20 mm. The width $S_2$ of the nozzle slot 32 in the Coanda nozzle 16*a* of FIGS. 3 and 4 is, generally, within the range of 0.5 to 5 mm., and preferably within the range of between about 2 to 3 mm. As a rule, when Coanda nozzles are used, the width $S_2$ of the nozzle slot 32 is considerably smaller than the width $S_1$ of the gap S, for example, $S_1$ is generally 2 to 4 times the size of $S_2$.

The positive pressure obtained in the blow box 12 of pressure chamber K+ is sufficiently high so that a high enough speed for the air jets is obtained through nozzle slots 32;32' to obtain a sufficiently high ejection effect, i.e., so that the air currents $E_a$ and $E_b$ are sufficiently high to produce the non-contacting air seals and, at least in part, a negative pressure in the suction chamber K− and over the suction sector a. The speed of the air, such as in the nozzle slots 32 of a Coanda nozzle **16*a*** is generally within the range of between about 15 to 40 m/s.

The construction and location of the blow nozzles used in methods and apparatus in accordance with the invention may vary considerably from the illustrated embodiments. Most advantageously, blow nozzles based on the Coanda principle are used for forming non-contacting air seals. As is well known, the ejection effect of the nozzles is based on the fact that the air jets $F_a$ and $F_b$ directed through the blow nozzles at a high speed will produce a dynamic negative pressure in accordance with Bernoulli's law and the negative pressure in turn generates or produces the ejected air currents $E_a$ and $E_b$.

The inner surface 10'' of mantle 10 of roll 100–107 in accordance with the invention may be entirely unmachined thereby permitting a more favorable manufacturing technique from the cost viewpoint.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for applying a negative pressure over a suction sector of an air-pervious mantle of a roll, comprising the steps of:

providing a suction chamber within said pervious roll mantle to extend over said suction sector of said roll, said suction chamber having a pair of circumferentially spaced, axially extending outermost edge zones situated directly adjacent to and forming respective gaps with an inner surface of said pervious roll mantle, said outermost edge zones defining boundaries of said suction chamber;

directing air jets away from said suction chamber at said outermost edge portions of said suction chamber through said gaps, said gaps being sufficiently small so that said air jets cause air currents to be ejected from said suction chamber at said outermost edge zones thereof; and said air currents producing non-contacting air seals at said gaps at said outermost edge zones of said suction chamber and, at least partly, a negative pressure in said suction chamber.

2. The method of claim 1 wherein said negative pressure produced in said suction chamber is in the range of between about 50 to 300 Pa.

3. The method of claim 1 wherein said suction chamber has a pair of axial ends and further including sealing at least one of said axial ends of said suction chamber by directing air jets away from said suction chamber at said at least one axial end thereof, without the use of contact-type sealing elements.

4. The method of claim 1 wherein said suction chamber has a pair of axial ends and further including sealing at least one of said axial ends of said suction chamber by providing a sealing member which is spaced a small distance from said inner surface of said mantel.

5. The method of claim 4 wherein said small distance is less than about 2 mm.

6. The method of claim 1 wherein said air jets are directed through nozzle slots provided at said outermost edge portions of said suction chamber, said air jets being directed by the Coanda principle.

7. The method of claim 1 wherein said air jets are directed through blow nozzles provided at said outermost edge portions of said suction chamber, each of said blow nozzles including an outer wall forming said gap with said inner surface of said roll mantle, and wherein said air jets are directed substantially parallel to the tangent of said mantle at the region of said blow nozzles.

8. The method of claim 1 including the further step of communicating said suction chamber with a source of negative pressure so that the negative pressure produced by means of said ejected air currents is only a part of a total negative pressure produced in said suction chamber.

9. A suction roll, comprising:

a cylindrical air-pervious mantle, said mantle having ends at which said mantle is mounted for rotation, said mantle defining an interior space therewithin;

a suction chamber situated in said interior space, said suction chamber being defined by first axially extending wall means having outermost edge portions situated directly adjacent to an inner surface of said roll mantle forming respective gaps therewith defining boundaries of said suction chamber, said mantle having a suction sector defined between said boundaries;

a pressure chamber situated in said interior space in communication with said suction chamber including means for connection to a pressure source; and blow nozzle means for directing air jets away from said suction chamber through said gaps, said blow nozzle means having inlet sides communicating with said pressure chamber, said gaps being sufficiently small so that said air jets cause air currents to be ejected from said suction chamber through said gaps at said outermost edge portions of said first wall means, said blow nozzle means structured so that said air currents produce non-contacting seals at said gaps at said outermost edge portions of said wall means and, at least partly, a negative pressure in said suction chamber.

10. The suction roll of claim 11 wherein said blow nozzle means direct said air jets substantially parallel to the tangent of said mantle at the region of said blow nozzle means.

11. The suction roll of claim 9, wherein said suction chamber communicates with a suction sector of said pervious roll mantle and wherein said pressure chamber communicates with a pressure sector with said roll outside of said suction sector, and wherein said pressure chamber includes second axially extending wall means which also extend between said blow nozzle means, said second wall means and said pressure sector of said roll define said pressure chamber, said air jets directed through said blow nozzle means and said air currents ejected from said suction chamber being directed into said pressure chamber to create a discharge air flow through said pressure sector of said pervious mantle.

12. The suction roll of claim 11 further including a stationary air inlet pipe situated within said interior space defined within said roll mantle, said first and second wall means defining said suction and pressure chambers being attached to said air inlet pipe, said pipe being provided with openings communicating with said pressure chamber.

13. The suction roll of claim 9 wherein said suction chamber has a pair of axial ends, and further including end blow nozzle means situated at the axial ends of said suction chamber for directing air jets away from said suction sector so that the use of contact-type sealing elements can be eliminated at the axial ends of said suction chamber.

14. The suction roll of claim 9 wherein said blow nozzle means comprise nozzle slots operating by the Coanda principle.

15. The suction roll of claim 9 wherein each of said blow nozzle means comprise a series of openings provided in a wall situated substantially in a plane containing the axis of said suction roll.

16. The suction roll of claim 9 wherein said blow nozzle means each include an outer wall forming said gap with said inner surface of said roll mantel.

17. The suction roll of claim 16 wherein said gap is in the range of between about 3 to 30 mm.

18. The suction roll of claim 17 wherein said gap is in the range of between about 8 to 20 mm.

19. The suction roll of claim 9 wherein said blow nozzle means comprise nozzle slots and wherein the width of said nozzle slots is in the range of between about 0.5 to 5 mm.

20. The suction roll of claim 19 wherein the width of said nozzle slots is in the range of between about 2 to 3 mm.

21. Apparatus for handling web material, said apparatus including in combination therewith at least one suction roll, comprising:

a suction roll including an air-pervious mantle having ends at which said mantle is mounted for rotation, said mantle defining an interior space therewithin; a suction chamber situated in said interior space, said suction chamber being defined by first axially extending wall means having outermost edge portions situated directly adjacent to an inner surface of said roll mantle and forming respective gaps therewith defining boundaries of said suction chamber, said mantle having a suction sector defined between said boundaries; a pressure chamber situated in said interior space in communication with said suction chamber including means for connection to a pressure source; and blow nozzle means for directing air jets away from said suction chamber through said gaps, said gaps being sufficiently small so that said air jets cause air currents to be ejected out from said suction chamber through said gaps at said outermost edge portions of said first wall means, said blow nozzle means structured so that said air currents produce non-contacting seals at said gaps at said outermost edge portions of said wall means and, at least partly, a negative pressure in said suction chamber.

22. The combination of claim 21 wherein said apparatus comprises a single-wire draw drying section of a paper machine including a group of drying cylinders including a line of drying cylinders, said at least one suction roll comprising an idler roll in said drying section, and a drying wire carrying said web into contact with said drying cylinders of said line with said drying wire being situated within said web and said suction sector of said suction roll whereby said suction sector maintains the web in contact with said drying wire over said suction roll.

23. The combination of claim 21 wherein said apparatus comprises a twin-wire draw drying section of a paper machine including upper and lower lines of drying cylinders, said at least one suction roll comprising an idler roll in said drying section, upper and lower drying wires carrying said web into contact with said drying cylinders of said upper and lower lines, transfer nips formed in connection with said idler rolls in which said web is transferred from one drying wire onto the other, and wherein the web is maintained in contact with a drying wire by means of said suction sector of said suction roll.

24. The combination of claim 21 wherein said apparatus comprises a cutting means for cutting said web into sheets, said at least one suction roll acting to shift said web or sheets cut therefrom forwardly and wherein said suction sector acts as a holding zone within which the web or sheets cut therefrom is held in contact with said suction roll.

25. The combination of claim 21 wherein said apparatus comprises a twin-wire draw drying section of a paper machine and wherein at least one suction roll comprises a combined felt guide roll and pocket ventilation roll, and wherein said suction sector comprises means for removing moist air from a pocket space of said drying section and wherein warm, dry air is used as blow air for said air jets, said warm, dry air being used in said pocket space as drying pocket ventilation air.

* * * * *